United States Patent [19]

Bell et al.

[11] 4,161,308

[45] Jul. 17, 1979

[54] SWITCHING VALVE ASSEMBLY FOR FLUID MOTOR-DRIVEN INJECTOR PUMP

[75] Inventors: Robert R. Bell; William H. Alexander, both of Houston, Tex.

[73] Assignee: Vapor Corporation, Chicago, Ill.

[21] Appl. No.: 805,142

[22] Filed: Jun. 9, 1977

Related U.S. Application Data

[63] Continuation-in-part of Ser. No. 666,920, Mar. 15, 1976, abandoned.

[51] Int. Cl.[2] ..... F16K 1/16; F01L 25/02; F04B 17/00; F04B 35/00

[52] U.S. Cl. ..... 251/228; 251/303; 251/339; 91/306; 91/336; 91/337; 417/403

[58] Field of Search ..... 417/398, 399, 402, 403, 417/404; 91/335, 336, 337, 305, 306; 251/228, 251, 339, 364, 365, 363, 303

[56] References Cited

U.S. PATENT DOCUMENTS

| | | | |
|---|---|---|---|
| 149,067 | 3/1874 | Rogers | 91/306 |
| 610,744 | 9/1898 | Henion | 251/365 |
| 2,210,046 | 8/1940 | Schobring | 251/365 |
| 2,314,553 | 3/1943 | Palm | 251/228 |
| 2,471,880 | 5/1949 | McDonald | 251/365 |
| 2,574,923 | 11/1951 | La Brie | 251/228 |
| 2,574,969 | 11/1951 | Heidloff | 251/228 |
| 2,834,295 | 5/1958 | Hjarpe | 91/337 |
| 2,964,013 | 12/1960 | Mitchell et al. | 91/335 |
| 3,041,975 | 7/1962 | Atherton et al. | 91/335 |
| 3,103,945 | 9/1963 | Hoare | 251/303 |
| 3,174,409 | 3/1965 | Hill | 91/306 |
| 3,212,406 | 10/1965 | McDuffie | 417/403 |
| 3,299,826 | 1/1967 | Williams | 91/335 |
| 3,369,566 | 2/1968 | Schmitt et al. | 251/228 |
| 3,465,686 | 9/1969 | Nugier | 91/306 |
| 3,846,049 | 11/1974 | Douglas | 417/404 |
| 3,887,165 | 6/1975 | Thompson | 251/303 |
| 3,988,001 | 10/1976 | Kankaras | 251/228 |

FOREIGN PATENT DOCUMENTS

| | | | |
|---|---|---|---|
| 1550327 | 9/1969 | Fed. Rep. of Germany | 251/303 |

*Primary Examiner*—Carlton R. Croyle
*Assistant Examiner*—Thomas I. Ross
*Attorney, Agent, or Firm*—Francis J. Lidd

[57] ABSTRACT

A pump for injecting metered amounts of liquid into a line or a conduit, which includes a reciprocating pumping piston in a cylindrical chamber having an inlet and an outlet, both of which are controlled by check valves, wherein the pumping piston is driven by a pneumatic motor of the reciprocating type and having a cylinder in which is located a power piston that is suitably connected to the pumping piston. A switching valve assembly is provided for controlling a supply of power gas or air to the pneumatic motor and which responds to the movement of the pumping and power pistons for effecting reciprocal movement of the pistons.

1 Claim, 10 Drawing Figures

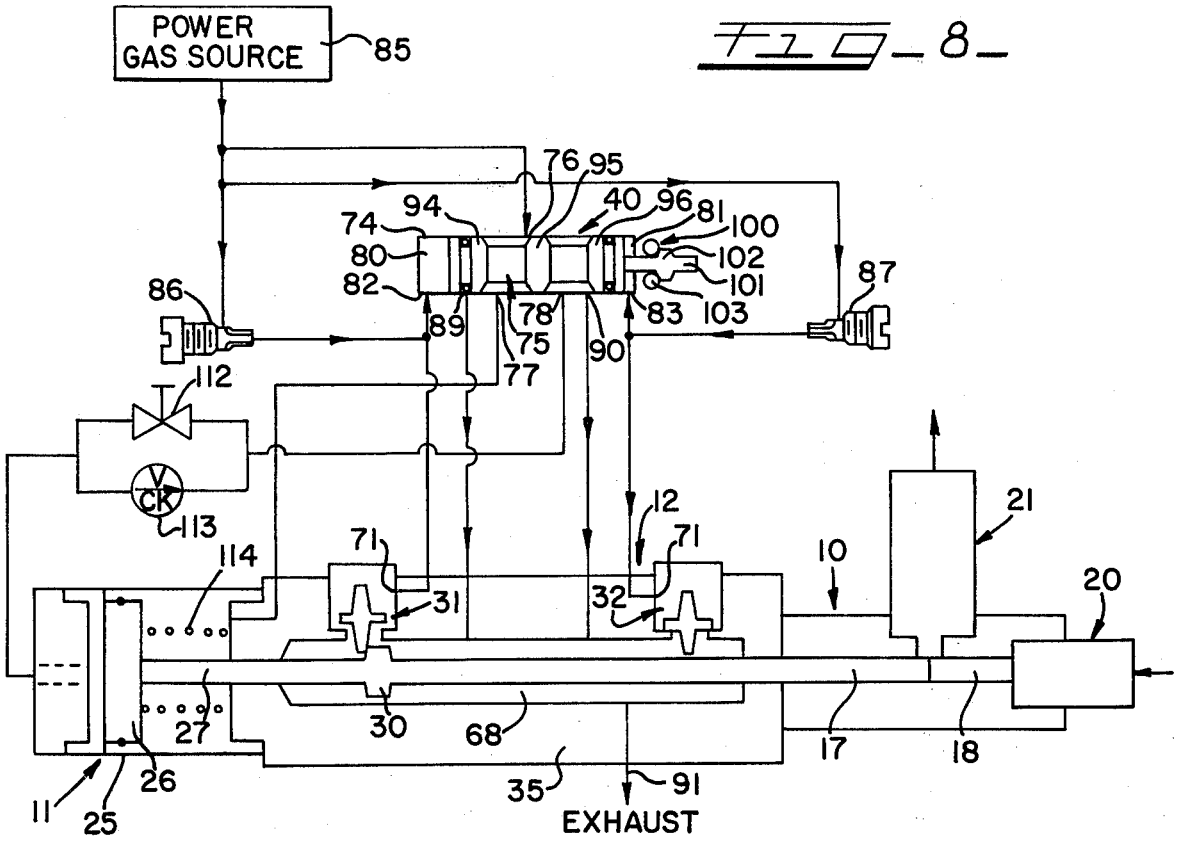
FIG. 8
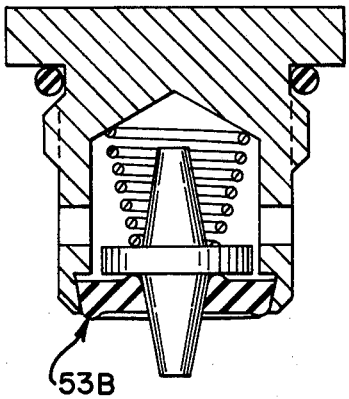
FIG. 9
FIG. 10
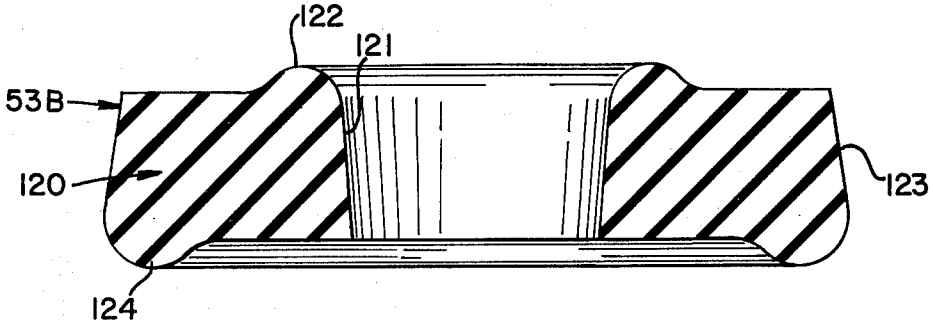

SWITCHING VALVE ASSEMBLY FOR FLUID MOTOR-DRIVEN INJECTOR PUMP

This application is a continuation-in-part of our abandoned application Ser. No. 666,920, filed Mar. 15, 1976.

This invention relates in general to a positive displacement injector pump, and more particularly to an injector pump having a unique switching valve arrangement for effecting continuous operation of the pump.

The pump of the present invention is especially useful for metering small amounts of liquid into lines or conduits carrying various types of products. For example, the pump may be used to inject chemicals into an oil pipe line. The pump of the present invention requires a minimum of maintenance in that it is simple in construction. Further, the pump is easy to service and capable of dependable operation under a wide range of conditions. The pump of the invention is operable by power gas or air which is a readily available commodity in connection with oil pipe line installations. Heretofore, such pumps have been of the diaphragm type, such as shown in U.S. Pat. No. 3,327,635, or of the piston and return spring type with a diaphragm operated switching valve, such as shown in U.S. Pat. No. 3,387,563.

The pump of the present invention is more simply constructed than pumps heretofore known, and more dependable with respect to positive displacement characteristics. The pump incorporates a spool valve for coaction with a pumping piston and a power piston for controlling the feed of power gas to the power piston in conjunction with poppet-type dumping valves operable in response to movement of the pumping and power pistons. The output of the pump is controlled by the speed of the pumping and power pistons which is dependent upon the pressure of the power gas used to drive the power piston. Shifting of the spool in the spool valve accomplishes the reciprocal movement of the pumping and power pistons and the alternating supply and exhaust conditions at the oppisite ends of the power piston. Poppet valves responsive to movement of the pumping and power pistons effect shifting of the spool in the spool valve for controlling the supply and exhaust of the gas at the power piston. It may therefore be appreciated that a single supply of power gas or air is needed to drive the pump of the invention and obtain accurate injection of a liquid into a line or conduit.

Accordingly, it is an object of the present invention to provide a new and improved positive displacement injector pump having a unique switching valve arrangement.

Another object of the invention is in the provision of a new and improved pneumatic switching or oscillating mechanism for a double-acting power cylinder.

A further object of this invention is to provide a pneumatic switching mechanism for a double-acting power cylinder that reliably operates over a wide temperature range.

A still further object of this invention is in the provision of a tilt-type poppet-type dumping valve assembly for a pneumatic switching device that may be quickly and easily replaced, thereby minimizing down time.

Another object of the invention is to provide a unique tilt-type poppet valve capable of providing reliable operation and being easily maintained.

Other objects, features and advantages of the invention will be apparent from the following detailed disclosure, taken in conjunction with the accompanying sheets of drawings, wherein like reference numerals refer to like parts, in which:

FIG. 8 is a schematic diagram like that shown in FIG. 5, but showing a modified switching valve assembly;

FIG. 9 is an enlarged vertical sectional view of a poppet valve assembly according to the invention and showing a still further modified seat; and FIG. 10 is an enlarged vertical sectional view of the seat illustrated in the poppet valve assembly of FIG. 9.

Figure 1:
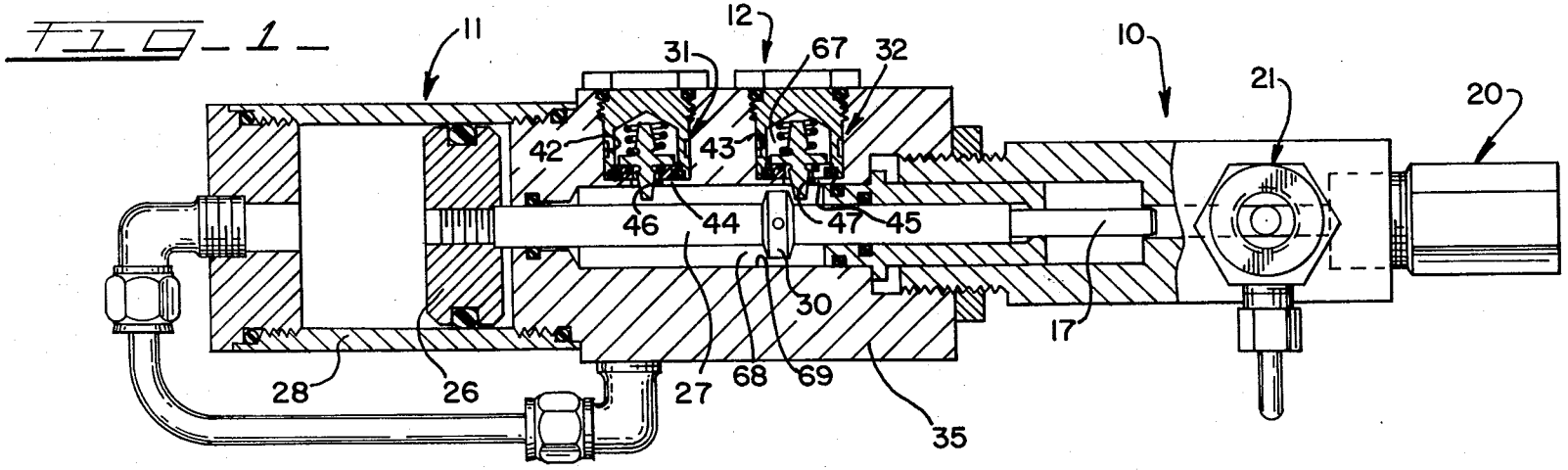
FIG. 1 is a longitudinal sectional view taken horizontally through the injector pump of the present invention.
Figure 2:
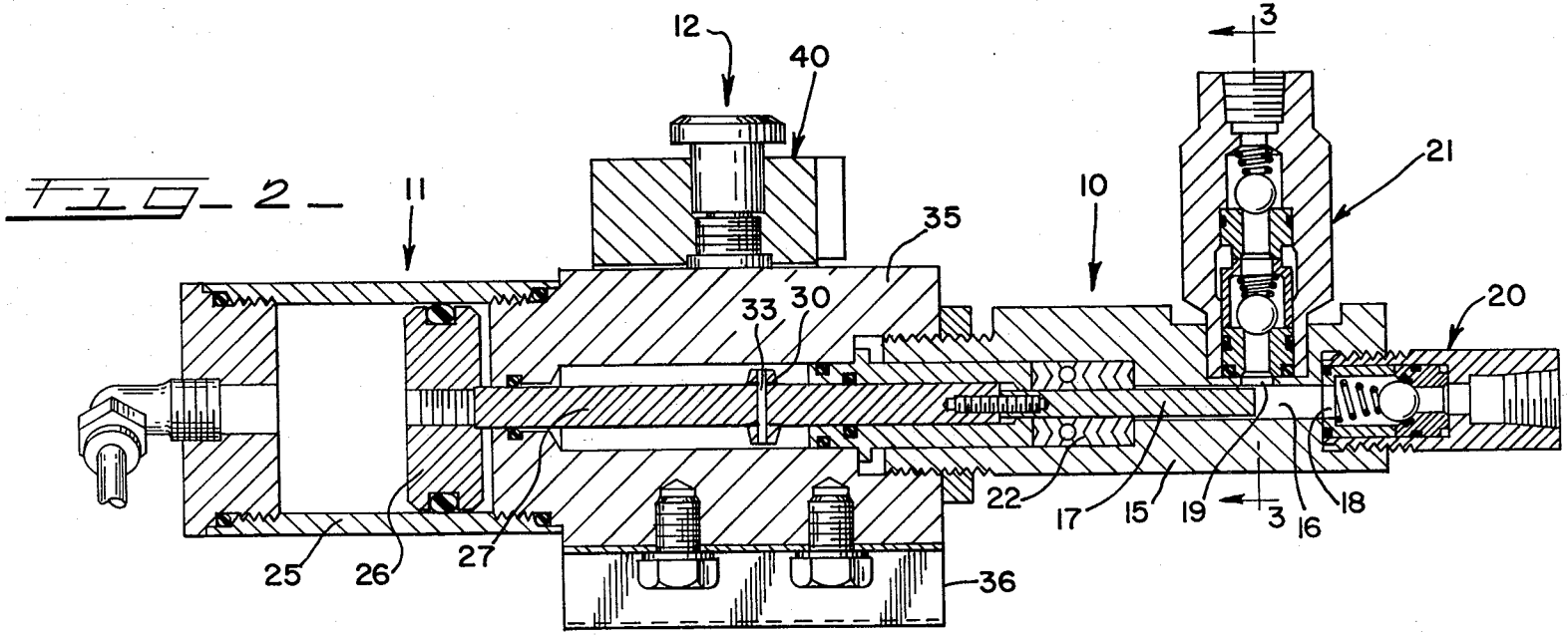
FIG. 2 is a longitudinal sectional view taken vertically through the injector pump of the invention.

Referring now to the drawings, and particularly to FIGS. 1 and 2, the positive displacement injector pump of the invention includes generally a pump fluid end assembly 10, a power end assembly 11 and a switching device assembly 12 which accomplishes the operation of the power end assembly 11. The pump fluid end assembly is mounted on one end of the switching device assembly and the power end assembly is mounted on the other end of the switching device assembly in the embodiment illustrated.

The pump fluid end assembly 10 includes a pump housing 15 having a cylindrical pumping chamber 16 in which the pumping piston 17 reciprocates. The pumping chamber 16 includes an axially aligned inlet 18 and a radially aligned outlet 19. A conventional ball check valve assembly 20 communicates with the inlet 18, while a double ball check valve assembly 21 with a built-in bleeder valve is mounted at the outlet 19. However, a single ball check valve assembly may be utilized at the outlet 19 if so desired. The double ball check valve assembly 21 illustrated is especially useful for very slow speed applications and where difficult priming conditions may exist. A suitable seal assembly 22 coacts with the pumping piston 17 to prevent leakage through the rod end of the piston housing. Accordingly, the inlet 18 functions as the suction side of the pump, while the outlet 19 functions as the discharge side of the pump by virtue of the check valve assembly arrangement.

A pump fluid end assembly 10 is driven by the power end assembly 11 which includes a cylinder 25 within which a power piston 26 is reciprocably received and interconnected with the pumping piston 17 through a piston rod or connecting rod 27. The power cylinder is driven by power gas or air and is double-acting by virtue of combination inlet-exhaust ports in the cylinder at opposite sides of the piston 26 and as diagrammatically shown in FIG. 5.

It will be appreciated that the ball check valve assemblies 20 and 21 are respectively suitably connected to a source of liquid desired to be injected into a line or conduit in metered amounts. Accordingly, it can be appreciated that the check valve assembly 21 will be connected directly to an oil pipe line for injecting metered amounts of liquid coming from a supply connected to the check valve assembly 20. Reciprocation of the pump piston 17 by action of the power piston 26 successively fills the pumping chamber 16 with liquid on the suction stroke and discharges the liquid through the outlet 19 on the discharge stroke.

The switching device assembly 12 controls the alternate feed of power gas to the opposite sides of the power piston 26 in coaction with movement of the power piston rod 27 which at the end of the pumping and suction strokes of the pumping piston 17 by the cam or actuator 30 alternately opens normally closed poppet-type dumping valves 31 and 32. The cam 30, as illustrated, is in the form of a ring connected to the power piston rod by means of a pin 33, and the opposite sides of the ring are beveled to facilitate the coaction with the dumping valves 31 and 32. The dumping valves 31 and 32 are mounted in a switching device housing 35 to which at opposite ends are suitably secured the pumping fluid end assembly 10 and the power end assembly 11. A bracket 36 is secured to the underside of the housing 35 for purposes of facilitating securement of the entire injector pump to a suitable structure, such as a mounting pipe. The switching device additionally includes a spool valve 40.

Figure 4:
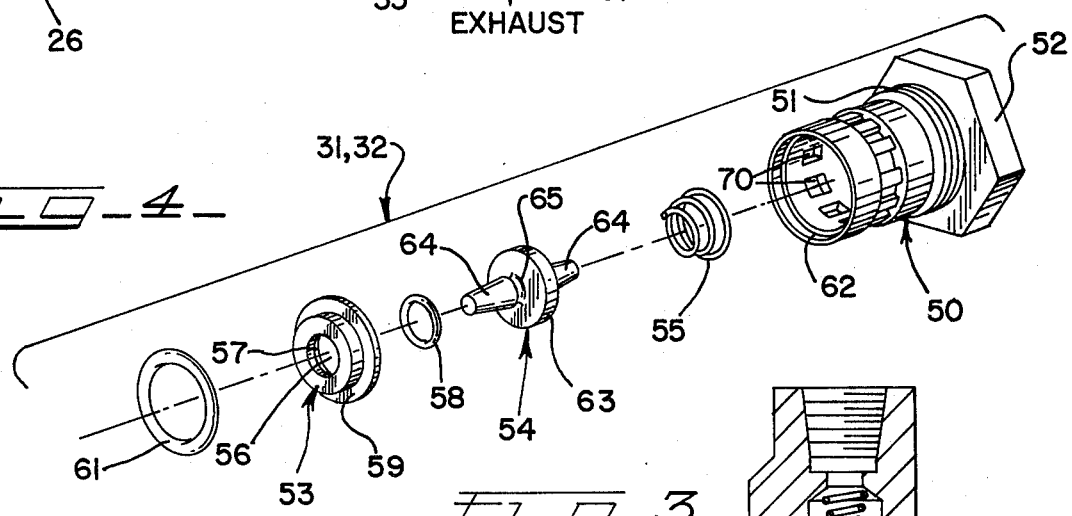
FIG. 4 is an exploded perspective view of a poppet valve assembly according to the invention.
Figure 3:
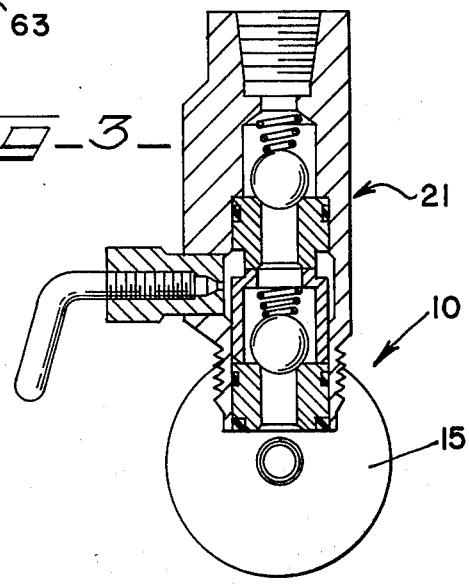
FIG. 3 is a transverse sectional view taken substantially along line 3–3 of FIG. 2.

The normally closed dumping valves 31 and 32 are identical in structure and, as seen in FIG. 1, are respectively mounted in cavities 42 and 43 formed in the switching device housing 35. The cavities 42 and 43 respectively include end walls 44 and 45 against which the dumping valve assemblies bottom. The end walls are respectively provided with openings 46 and 47 through which extend actuator portions of the dumping valves as will be more clearly hereinafter explained which may be engaged by the cam 30. Further, the cavities 31 and 32 are suitably provided with threaded portions for coacting with threads formed on the dumping valve housings. A more specific showing of the dumping valve structure is illustrated in FIG. 4.

Figure 6:
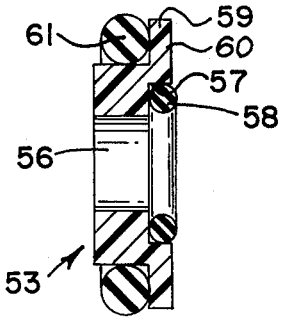
FIG. 6 is an enlarged diametrical sectional view of one form of seat and O-ring assembly for a poppet valve.

Each dumping valve includes a casing 50 which is generally cylindrical in form and provided with external threads 51 to threadedly mate with the threads formed in the cavities of the switching device housing 35. A hexagonally formed head 52 is provided at one end and which facilitates handling by a suitable wrench during the removal of a dumping valve from the switching device housing and the reinstallation thereof. It can be here appreciated that the dumping valves are an entire assembly which may easily be replaced in the event that they begin to malfunction without causing any undue down time for the injector pump of the invention. The dumping valve embodiment shown in FIG. 4 further includes a seat 53 in the form of a ring and a closure member or poppet 54 coacting with the seat and being normally biased into sealing engagement therewith by means of a coil spring 55. The seat 53 is in the form of a ring of a relatively hard material such as a molded nylon or the like having a central opening 56 therethrough which includes at the side facing the closure member 54 an O-ring shoulder or notch 57 for receiving a resilient O-ring 58 of elastomeric material. The O-ring is preferably sized so that it will project slightly above the face 60 of the seal, as seen in FIG. 6. At the outer periphery of the seat and facing the side away from the closure member 54, an O-ring shoulder or notch 59 is provided to coact with a resilient O-ring 61 of elastomeric material that also coacts with an internally formed O-ring shoulder or notch 62 on the opening end of the casing 50 for sealing around the outer periphery of the seat relative to the casing. Additionally, the O-ring 61 is sized to form an interference fit that frictionally holds the seat 53 in position relative the casing 50 against the pressure of the spring 55 so that the dumping valve structure is formed as a unit so that it may be easily removed and replaced from the switching device housing 35. Further, the O-ring 61 seals against the end wall of the cavity in the switching device housing 35.

Figure 7:
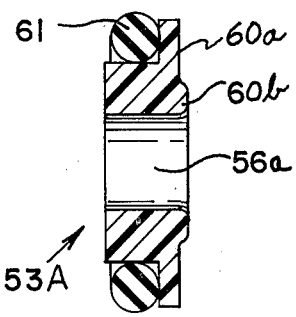
FIG. 7 is an enlarged diametrical sectional view of another form of seat.

Alternately, the seat 53 may be resilient and made of an elastomeric material suitable for sealing engagement with poppet 54 without the use of O-ring 58 and notch 57 as shown in FIG. 7 and indicated by the numeral 53A. Preferably, the face **60*a* is provided with an annular raised portion 60*b* around the opening 56*a*** against which the poppet engages.

A further seat embodiment is shown in FIGS. 9 and 10 which is generally indicated by the numeral 53B and which differs from the embodiment of FIG. 7 in that a unitary molded structure forms the entire seat structure that seals with respect to the casing 50 and the housing 35. The seat includes a body 120 having a passageway 121 extending centrally therethrough and conically formed with the larger end at the upper or inlet side. An annular rim or lip 122 having a rounded in cross section shape is formed at the inlet side defining an edge against which the base of poppet 54 seats and pivots. The area outside the lip 122 being lower than the uppermost point of the lip defines a recessed area for the edge of the poppet base when it tilts. The outer generally vertical face 123 is conically formed with the smaller end at the inlet side. An outer rim or lip 124 is formed at the outer periphery of the lower or outlet side of the body which coacts with the casing 50 and the housing 35 to seal against leakage between the seat and the casing. The seat is sized externally to wedge in place in the casing and hold the poppet and spring in place, as seen in FIG. 9. The seat is molded of a suitable elastomeric material, such as an 80 durometer hardness Buna-N rubber.

The closure member 54 or poppet includes a central disk-shaped base 63 having a cylindrical or annular groove 65 and oppositely extending truncated conoidal or tapered pins or arms 64. The closure member 54 is generally symmetrically formed so that it can be inserted in either direction relative the seat 53 wherein the pin or arm 64 extending through the opening of the seat is engageable by the actuator or cam 30 on the power piston rod while the oppositely extending pin or arm 64 functions as a guide in coaction with the spring 55 to maintain the spring substantially centered relative the closure member. Further, the symmetrical form defines a weight balanced poppet. Accordingly, one of the arms may be defined as an actuating arm, while the other may be defined as a guide arm. The closure member may be made of any suitable relatively hard material, such as a molded nylon or the like. It can readily be appreciated when the cam 30 engages the closure member arm, it will tilt the closure member or poppet relative the seat to thereby open the valve, and in particular, intercommunicate the chambers 67 shown in FIG. 1 of the valve with a dumping chamber 68 formed by a bore 69 extending through the housing 35. The connecting rod 27 moves through the bore 69. The chamber 68 is suitably connected to the atmosphere, while the chamber 67 is connected through apertures 70 formed in the valve casing 50 with the inlet 71 to the valve, as shown diagrammatically in FIG. 5.

Figure 5:
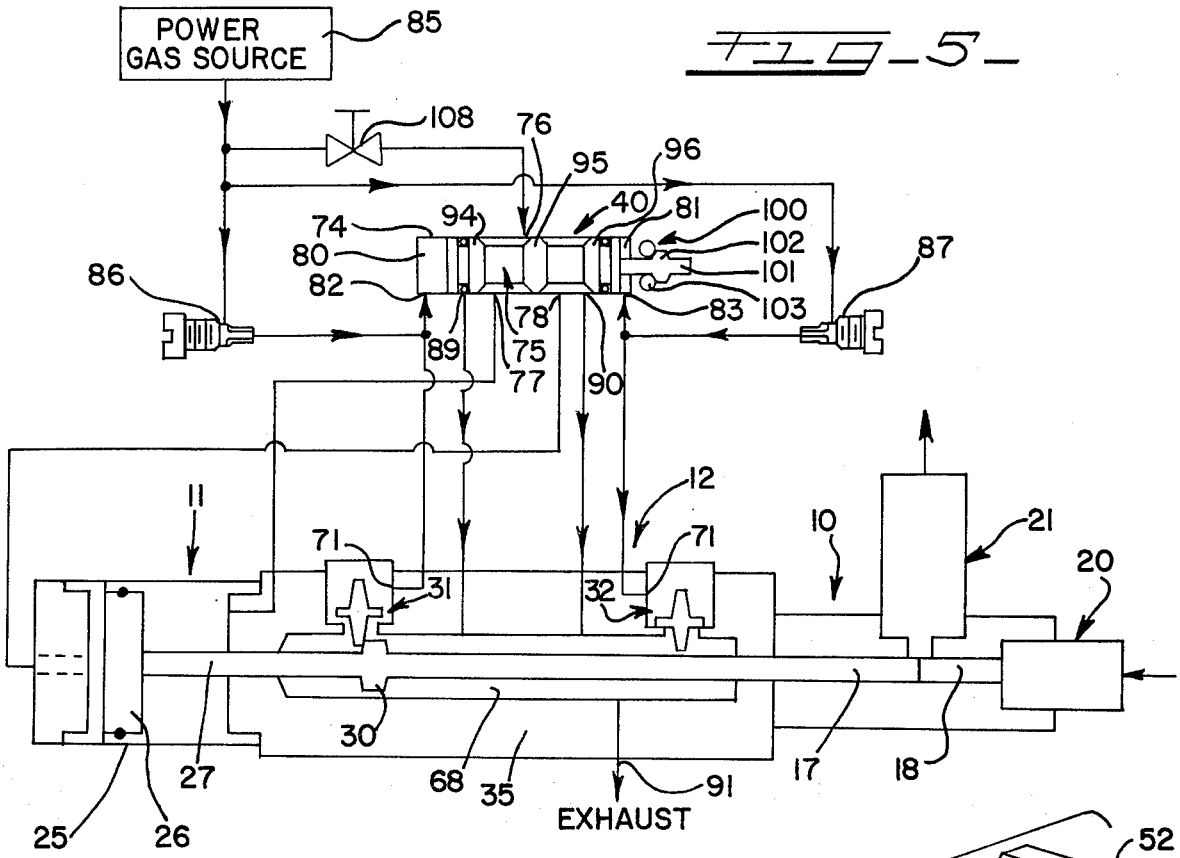
FIG. 5 is a schematic diagram of the pump of the present invention and illustrating the connections between the pump and the switching valve assembly.

Referring now to FIG. 5, the structure of the spool valve 40 can be seen, which includes a cylinder 74 having slidable therein between first and second positions a spool 75. The cylinder generally includes a power gas or air inlet port 76 and outlet ports 77 and 78 which are respectively connected to opposite ends of the cylinder 25 of the power cylinder 11 to control the pressures at the opposite ends of the power piston 26. Additionally, the spool valve cylinder 74 includes opposite end cavities or chambers 80 and 81 provided with ports 82 and 83. Movement of the spool is accomplished by maintaining a balanced supply of power gas in the end cavities 80 and 81 which may be selectably dumped by the dumping valves 31 and 32 to create an unbalance of pressure such as to cause shifting of the spool.

Power gas is delivered to the end cavities from a power gas source 85 respectively through metering orifices having adjustable orifice screws 86 and 87 which regulate the amount of power gas to the end cavities that are also interconnected to the inlets 71 of the dumping valves 31 and 32. When the dumping valves are closed, full pressure can be built up in the end cavities, and when one of the dumping valves is opened, it will relieve the pressure built up wherein the pressure at the opposite end cavity overcomes the friction between the spool and the cylinder to shift the spool toward the end of the cylinder where the pressure has been dumped by virtue of opening a poppet valve. Regulation of the power gas to the cavities regulates the frequency of movement of the spool and thereby the frequency or speed of pumping by the pump 10. Therefore, the pumping speed and metering of fluid by the pump can be regulated by adjusting the orifice screws. The time periods between shifting of the spool from one end to the other end may be equal or unequal depending on the orifice screws.

Exhaust ports 89 and 90 are also provided in the spool valve cylinder 74 for respectively exhausting power gas from opposite ends of the power piston 26. These exhaust ports are connected to the exhaust chamber or low pressure chamber 68 in the switching device housing 35. The chamber 68, as shown in FIG. 5, is suitably in communication with the atmosphere through an exhaust port 91. It can be appreciated that the exhaust chamber 68 need not be specifically in communication with the atmosphere but may be in communication with any low pressure area.

The spool 75 includes lands 94, 95 and 96 which coact with the power gas inlet port 76, the outlet ports 77 and 78 and the exhaust ports 89 and 90 such that in the position illustrated in FIG. 5 the left end of the power piston 26 is connected to exhaust, while the power gas inlet port 76 is connected to the outlet port 77 to feed power gas to the right end of the power piston 26 and cause movement of the power piston to the position shown. Similarly, when the spool reaches the opposite position that is against the end cavity 80, the power gas inlet port 76 will then be interconnected to the outlet port 78 to feed power gas to the left end of the power piston 26 and cause movement of the power piston toward the right, while the outlet port 77 will be interconnected with the exhaust port 89 to connect the left end of the power piston to exhaust, and it can be appreciated that shifting of the spool toward the left is initiated by opening of the dumping valve 31. In this respect, the orifice defined by orifice screw 86 would function to retard the flow of power gas to achieve the pressure differential for a sufficiently long period of time to force movement of the spool to the side of the cylinder of lower pressure.

A detent mechanism 100 is provided to delay switching action and movement of the spool 75 until a given pressure differential is built up in the high pressure end cavity to cause rapid switching action. This detent mechanism may take any suitable form such as providing a connecting rod 101 for the spool 75 which in turn includes a cam 102 for engaging one or more spring-pressed balls 103.

The output of the pump fluid end 10 is controlled by the speed of the pump which is in turn controlled by a metering valve 108 that may be adjusted to provide the desired amount of power gas to the spool valve 40. It can be appreciated that the pump may be operated on air or gas and that power gas can be exhausted to the atmosphere, vented to safe areas where no hazards exist, or piped into a lower pressure gas system. It should further be recognized that the pump will operate in a vertical or horizontal position. The orifice screw 86 and 87 which define a restricting orifice for feeding power gas to the end cavities of the spool valve may be easily removed to clean the gas passage inasmuch as there is a possibility of entrapping small particles in the orifice. From the foregoing, it can be appreciated that the dumping valves 31 and 32, which also may be defined as switching valves, are operated alternately by the cam 30 for relieving end cavity pressure in the spool valve to cause shifting of the spool and alternate feeding of power gas to the opposite ends of the power piston 26 to cause reciprocation of the pump.

The embodiment of FIG. 8 differs from the embodiment of FIG. 5 in that the pneumatic circuitry controls the flow of power gas in a manner that coacts with a spring for assisting the return stroke of the power piston to provide more reliable operation at low temperatures and to improve the stroking frequency of the power piston and therefore the pump over a wider temperature range. Specifically, the control valve between the power gas source and spool valve has been omitted and a control valve has been provided in parallel with a check valve between the spool valve and the chamber of the power cylinder which effects the pumping stroke of the pump. Additionally, a spring has been installed in the power cylinder to continuously resiliently bias the power piston in a direction of the return stroke of the pump.

A needle valve 112 or a suitable valve for adjusting gas flow is provided in parallel with a check valve 113 between the outlet 78 of the spool valve 40 and the end of the cylinder 25 on the side of the power piston which when pressurized will effect the pumping stroke of the pump 10. The check valve 113 is closed during the pressurizing of the cylinder for the pumping stroke but opens completely on the return stroke of the power piston and pump. Adjustment of the needle valve 112 controls the flow of power gas to the cylinder 25 when the spool valve 40 is conditioned to effect the pumping stroke. A spring 114 is provided in the power cylinder 25 to apply continuous biasing force to the power piston 26 for driving it in the direction of the return stroke of the pump. While it is necessary to provide an air pressure in the power cylinder during the pumping stroke of a sufficient nature to overcome the force exerted on the spring 114, it will be appreciated that on the return stroke of the pump, the spring will assist in returning the power piston to a position for the next pumping stroke and thereby provide more positive return and a snappier return during the return stroke. This will also assure a complete return of the power piston so that the metering action of the pump will be more accurate.

It will be understood that modifications and variations may be effected without departing from the scope of the novel concepts of the present invention, but it is understood that this application is to be limited only by the scope of the appended claims.

The invention is hereby claimed as follows:

1. A dumping valve assembly for a switching valve device comprising a casing, a ring-shaped valve seat of resilient material supported by said casing and having a fluid passageway extending centrally therethrough, said seat having inlet and outlet sides at the opposite ends of the fluid passageway, and a valve closure member resiliently biased against the inlet side of the seat and having an actuating arm extending through the passageway and being tiltable relative the seat for opening the valve assembly, said closure member including a disk-shaped central portion with the actuating arm extending from one side thereof, and a guide arm extending from the other side of said central portion, said arms being axially aligned along an axis extending through the center of the central portion and being conically shaped and identically formed whereby the closure member is symmetrical and weight balanced, whereby engagement and movement of the actuating arm causes the valve closure member to tilt and open the passageway.

* * * * *